US005783546A

United States Patent [19]

Bettiol et al.

[11] Patent Number: 5,783,546

[45] Date of Patent: Jul. 21, 1998

[54] AMYLASE-CONTAINING DETERGENT COMPOSITIONS

[75] Inventors: Jean-Luc Philippe Bettiol, Newcastle upon Tyne; Michael Alan John Moss, Northumberland; Christiaan Arthur Jacques Kamiel Thoen, Tyne & Wear, all of United Kingdom; Stanton Lane Boyer, Fairfield; Michael Stanford Showell, Cincinnati, both of Ohio; Janice Jeffrey, Newcastle upon Tyne, United Kingdom

[73] Assignee: Procter & Gamble Company, Cincinnati, Ohio

[21] Appl. No.: 722,088

[22] PCT Filed: Apr. 17, 1995

[86] PCT No.: PCT/US95/04710

§ 371 Date: Oct. 18, 1996

§ 102(e) Date: Oct. 18, 1996

[87] PCT Pub. No.: WO95/04710

PCT Pub. Date: Nov. 2, 1995

[30] Foreign Application Priority Data

Apr. 22, 1994 [EP] European Pat. Off. ..... 94302878

[51] Int. Cl.[6] ..... C11D 3/386; C11D 3/30; C11D 3/36

[52] U.S. Cl. ..... 510/305; 510/309; 510/320; 510/372; 510/374; 510/375; 510/392; 510/530; 435/203

[58] Field of Search ..... 510/305, 309, 510/320, 372, 374, 375, 392, 530; 435/203

[56] References Cited

U.S. PATENT DOCUMENTS

| | | | |
|---|---|---|---|
| 3,416,997 | 12/1968 | Barton | 195/66 |
| 4,011,169 | 3/1977 | Diehl et al. | 252/95 |
| 4,142,999 | 3/1979 | Bloching et al. | 510/393 |
| 4,377,602 | 3/1983 | Conrad | 426/656 |
| 4,381,247 | 4/1983 | Nakawaga et al. | 510/530 |
| 4,551,177 | 11/1985 | Trubiano et al. | 106/210 |
| 5,312,557 | 5/1994 | Onda et al. . | |
| 5,332,528 | 7/1994 | Pan et al. | 510/299 |
| 5,356,800 | 10/1994 | Jacquess et al. | 435/188 |
| 5,474,701 | 12/1995 | Jacquess et al. | 435/198 |
| 5,507,952 | 4/1996 | Jacquess et al. | 210/632 |

FOREIGN PATENT DOCUMENTS

| | | | |
|---|---|---|---|
| WO 86/05187 | 9/1986 | WIPO | C07H 3/00 |
| WO 92/05239 | 4/1992 | WIPO | C11D 3/386 |
| WO 93/20175 | 10/1993 | WIPO | C11D 3/386 |
| WO 94/02597 | 2/1994 | WIPO | C12N 9/28 |

*Primary Examiner*—Kery A. Fries

*Attorney, Agent, or Firm*—C. Brant Cook; K. W. Zerby; B. M. Bolam

[57] ABSTRACT

A detergent composition comprising an amylase enzyme which shows CMCase activity and/or is an amylase showing a positive immunological cross reaction with the antibody of the Fungamyl amylase, or an amylase produced by a host organism in which the gene encoding the Fungamyl has been cloned.

7 Claims, No Drawings

AMYLASE-CONTAINING DETERGENT COMPOSITIONS

TECHNICAL FIELD

The present invention relates to detergent compositions containing specific amylases.

BACKGROUND OF THE INVENTION

The use of amylases in detergent compositions is well known in the art.

The practical use of amylases in detergents has however been limited so far to bacterial amylases such as Termamyl®, BAN® sold by Novo Nordisk, Maxamyl® and ex Gist-Brocades, Rapidase®.

On the other hand, certain fungal amylases are being sold by Novo Nordisk under the trade name Fungamyl®, for use in the starch industry, brewing industry, alcohol industry, and baking.

In the starch industry, Fungamyl® is used for production of high maltose syrups, or high conversion syrups. In the brewing industry, Fungamyl® is added during fermentation in order to increase fermentability of the wort. In the alcohol industry, Fungamyl® may be used for liquefaction of starch in a distillery mash. In baking, Fungamyl® is used for supplementation of wheat flour low in alpha-amylase.

Fungamyl® is however not used nor suggested for use, in detergent applications; furthermore, the trade brochure from Novo Nordisk, indicates that alkaline pHs have a detrimental effect on Fungamyl® activity.

It has now been surprisingly found that Fungamyl® can provide substantial cleaning benefits, especially in laundry context as regards whiteness maintenance and cleaning of body soils, these benefits being seen as well at alkaline pHs.

It has also been found that said Fungamyl® enzymes exhibit CMCase activity, contrary to the currently used amylase described above.

It is accordingly the object of the present invention to provide detergent compositions containing an amylase enzyme which showing CMCase activity and/or is an amylase showing a positive immunological cross reaction with the antibody of the Fungamyl® amylase, or an amylase produced by a host organism in which the gene encoding the Fungamyl® has been cloned.

SUMMARY OF THE INVENTION

A detergent composition comprising an amylase enzyme which shows CMCase activity and/or is an amylase showing a positive immunological cross reaction with the antibody of the Fungamyl® amylase, or an amylase produced by a host organism in which the gene encoding the Fungamyl® has been cloned.

DETAILED DESCRIPTION OF THE INVENTION

The Amylase

The compositions herein comprise as an essential ingredient a specific amylase, which shows CMCase and/or is an amylase showing a positive immunological cross reaction with the antibody of the Fungamyl® amylase, or an amylase produced by a host organism in which the gene encoding the Fungamyl® has been cloned. Fungamyl® is described by Novo Nordisk trade brochure dated February 1993, as being a 1,4- -D-glucan glucano-hydrolase, obtainable from a selected stain of *Asperillys oryzae*.

The CMCase activity of the amylase herein is defined and as follows:

An aqueous solution of CMC(1000 g/l) is incubated at pH 10.5 adjusted with NCOH and 50C, in the presence of amylase (0.05 g of an amylase solution at 800 FAU/g). The amylase is considered to have CMCase activity if after 1 minute incubation, at least 0.1, more preferably 0.5, most preferable 1 ppm or more glucose is formed as detected by ion chrmoatography/pulsed amperometric detection (IC/PAD).

In the tests run with Fungamyl® 0.05 g of 800FAU/l amylase was added to 100 ml of the CMC (1000 g/l) solution.

A Dionex 4500 gradient ion chromatography system was used with an AS7 column. H20/100 mM NaOH/500 mM Na Acetate eluents were used.

The PAD settings used were V T/sec

| | |
|---|---|
| E1 + 0.05 | 480 |
| E2 + 0.06 | 300 |
| E3 − 0.61 | 240 |

Polarity of the system is positive. The response time is 1 second.

The amylases of the present invention are preferably fungal and an example thereof is Fungamyl itself.

The Fungamyl® amylase herein should be used in a substantially pure form. By substantially pure form is meant, that the specific fungal alpha amylase of the invention should not be present in the form of an impurity included in another enzyme, separately added to the present composition to provided a different function.

However, it is understood that the substantially pure Fungamyl® can be used in conjunction with other enzymes.

The level of the fungal amylase in the composition of the invention should be such that an activity of from 1 to 5000 FAU/100 g of compositions (Fungal alpha-Amylase Unit), preferably 50 to 500.

One Fungal alpha-Amylase Unit (1 FAU) is the amount of enzyme which breaks down 5.26 g starch (Merck, Amylum solubile Erg. B. 6, Batch 9947275) per hour at Novo Nordisk's standard method for determination of alpha-amylase based upon the following standard conditions:

| | |
|---|---|
| Substrate | soluble starch |
| Reaction time | 7–20 min. |
| Temperature | 37° C. |
| pH | 4.7 |

Typically, a 800 FAU/g Fungamyl preparation will be used at levels of from 0.1 to 0.5% by weight of the detergent compositions herein.

The present amylase can be used in liquid or granular form, e.g. in the form of prills or marumes, possibly admixed or cogranulated with another optional enzyme as described hereinbelow.

The detergent compositions herein are preferably laundry detergent compositions, either in granular or liquid form, or can be laundry additives.

Automatic dishwashing compositions are also encompassed.

Granular and liquid laundry detergent compositions contain a surfactant and a laundry detergent builder as essential ingredients; the laundry addities herein will preferably consist in addition to the enzyme, of a bleaching agent; automatic dishwashing compositions contain a builder as an essential ingredient. Suitable surfactants and builders are described in detail hereinafter:

Alkyl Sulfate Surfactant

Alkyl sulfate surfactants hereof are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quarternary ammonium cations derived from alkylamines such as ethylamine, diethylamine, triethylamine, and mixtures thereof, and the like). Typically, alkyl chains of $C_{12-16}$ are preferred for lower wash temperatures (e.g., below about 50° C.) and $C_{16-18}$ alkyl chains are preferred for higher wash temperatures (e.g., above about 50° C.).

Alkyl Alkoxylated Sulfate Surfactant

Alkyl alkoxylated sulfate surfactants hereof are water soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 5, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethylammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate, $C_{12}$–$C_{18}E(1.0)M$), $C_{12}$–$C_{18}$ alkyl polyethoxylate (2.25) sulfate, $C_{12}$–$C_{18}E(2.25)M$), $C_{12}$–$C_{18}$ alkyl polyethoxylate (3.0) sulfate $C_{12}$–$C_{18}E(3.0)$, and $C_{12}$–$C_{18}$ alkyl polyethoxylate (4.0) sulfate $C_{12}$–$C_{18}E(4.0)M$), wherein M is conveniently selected from sodium and potassium.

Other Anionic Surfactants

Other anionic surfactants useful for detersive purposes can also be included in the laundry detergent compositions of the present invention with or without the species described above. These can include salts (including, for example, sodium, potassium, ammonium, and substituted ammonium salts such as mono-, di- and triethanolamine salts) of soap, $C_9$–$C_{20}$ linear alkylbenzenesulphonates, $C_8$–$C_{22}$ primary or secondary alkanesulphonates, $C_8$–$C_{24}$ olefinsulphonates, sulphonated polycarboxylic acids prepared by sulphonation of the pyrolyzed product of alkaline earth metal citrates, e.g., as described in British patent specification No. 1,082,179, $C_8$–$C_{24}$ alkylpolyglycolethersulfates (containing up to 10 moles of ehtylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO\text{-}M^+$wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

Preferred surfactants for use in the compositions herein are the alkyl sulfates, alkyl alkoxylated sulfates, and mixtures thereof.

When included therein, the laundry detergent compositions of the present invention typically comprise from about 1% to about 40%, preferably from about 3% to about 20% by weight of such anionic surfactants.

Nonionic Surfactants

The present laundry detergent compositions preferably also comprise a nonionic surfactant.

While any nonionic surfactant may be normally employed in the present invention, two families of nonionics have been found to be particularly useful. These are nonionic surfactants based on alkoxylated (especially ethoxylated) alcohols, and those nonionic surfactants based on amidation products of fatty acid esters and N-alkyl polyhydroxy amine. The amidation products of the esters and the amines are generally referred to herein as polyhydroxy fatty acid amides. Particularly useful in the present invention are mixtures comprising two or more nonionic surfactants wherein at least one nonionic surfactant is selected from each of the groups of alkoxylated alcohols and the polyhydroxy fatty acid amides.

Suitable nonionic surfactants include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Particularly preferred for use in the present invention are nonionic surfactants such as the polyethylene oxide condensates of alkyl phenols, e.g., the condensation products of alkyl phenols having an alkyl group containing from about 6 to 16 carbon atoms, in either a straight chain or branched chain configuration, with from about 4 to 25 moles of ethylene oxide per mole of alkyl phenol.

Preferred nonionics are the water-soluble condensation products of aliphatic alcohols containing from 8 to 22 carbon atoms, in either straight chain or branched configuration, with an average of up to 25 moles of ethylene oxide per more of alcohol. Particularly preferred are the condensation products of alcohols having an alkyl group containing from about 9 to 15 carbon atoms with from about 2 to 10 moles of ethylene oxide per mole of alcohol; and condensation products of propylene glycol with ethylene oxide. Most preferred are condensation products of alcohols having an alkyl group containing from about 12 to 15 carbon atoms with an average of about 3 to 7 moles of ethylene oxide per mole of alcohol, preferably 3 to 5.

The nonionic surfactant system herein can also include a polyhydroxy fatty acid amide component.

Polyhydroxy fatty acid amides may be produced by reacting a fatty acid ester and an N-alkyl polyhydroxy amine. The preferred amine for use in the present invention is N-(R1)-CH2(CH2OH)4-CH2-OH and the preferred ester is a C12–C20 fatty acid methyl ester. Most preferred is the reaction product of N-methyl glucamine with C12–C20 fatty acid methyl ester.

Methods of manufacturing polyhydroxy fatty acid amides have been described in WO 92 6073, published on 16th Apr., 1992. This application describes the preparation of polyhydroxy fatty acid amides in the presence of solvents. In a highly preferred embodiment of the invention N-methyl glucamine is reacted with a C12–C20 methyl ester. It also says that the formulator of granular detergent compositions may find it convenient to run the amidation reaction in the presence of solvents which comprise alkoxylated, especially ethoxylated (EO 3–8) C12–C14 alcohols (page 15, lines 22–27). This directly yields nonionic surfactant systems which are preferred in the present invention, such as those comprising N-methyl glucamide and C12–C14 alcohols with an average of 3 ethoxylate groups per molecule.

Nonionic surfactant systems, and granular detergents made from such systems have been described in WO 92 6160, published on 16th Apr., 1992. This application describes (example 15) a granular detergent composition prepared by fine dispersion mixing in an Eirich RV02 mixer which comprises N-methyl glucamide (10%), nonionic surfactant (10%).

Both of these patent applications describe nonionic surfactant systems together with suitable manufacturing processes for their synthesis, which have been found to be suitable for use in the present invention.

The polyhydroxy fatty acid amide may be present in compositions of the present invention at a level of from 0% to 50% by weight of the detergent component or composition, preferably from 5% to 40% by weight, even more preferably from 10% to 30% by weight.

Also useful as the nonionic surfactant of the surfactant systems of the present invention are the alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g. a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties (optionally the hydrophobic group is attached at the 2-, 3-, 4-, etc. positions thus giving a glucose or galactose as opposed to a glucoside or galactoside). The intersaccharide bonds can be, e.g., between the one position of the additional saccharide units and the 2-, 3-, 4-, and/or 6- positions on the preceding saccharide units.

The preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantely the 2-position.

Other Surfactants

The laundry detergent compositions of the present invention may also contain cationic, ampholytic, zwitterionic, and semi-polar surfactants, as well as nonionic surfactants other than those already described herein, including the semi-polar nonionic amine oxides described below.

Cationic detersive surfactants suitable for use in the laundry detergent compositions of the present invention are those having one long-chain hydrocarbyl group. Examples of such cationic surfactants include the ammonium surfactants such as alkyldi- or tri-methylammonium compounds, and those surfactants having the formula:

$$[R^2(OR^3)y][R^4(OR^3)y]_2R^5N+X-$$

wherein R2 is an alkyl or alkyl benzyl group having from about 8 to about 18 carbon atoms in the alkyl chain, each $R^3$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, $—CH_2COH—CHOHCOR^6CHOHCH_2OH$ wherein R6 is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Other cationic surfactants useful herein are also described in U.S. Pat. No. 4,228,044, Cambre, issued Oct. 14, 1980, incorporated herein by reference.

When included therein, the laundry detergent compositions of the present invention typically comprise from 0% to about 25%, preferably form about 3% to about 15% by weight of such cationic surfactants.

Ampholytic surfactants are also suitable for use in the laundry detergent compositions of the present invention. These surfactants can be broadly described as aliphatic derivatives of secondary or tertiary amines, or aliphatic derivatives of heterocyclic secondary and tertiary amines in which the aliphatic radical can be straight- or branched chain. One of the aliphatic substituents contains at least 8 carbon atoms, typically from about 8 to about 18 carbon atoms, and at least one contains an anionic water-solubilizing group e.g. carboxy, sulfonate, sulfate. See U.S. Pat. No. 3,929,678 to Laughlin et al., issued Dec. 30, 1975 at column 19, lines 18–35 (herein incorporated by reference) for examples of ampholytic surfactants.

When included therein, the laundry detergent compositions of the present invention typically comprise form 0% to about 15%, preferably from about 1% to about 10% by weight of such ampholytic surfactants.

Zwitterionic surfactants are also suitable for use in laundry detergent compositions. These surfactants can be broadly described as derivatives of secondary and tertiary amines, derivates of heterocyclic secondary and tertiary amines, or derivatives of quaternary ammonium, quarternary phosphonium or tertiary sulfonium compounds. See U.S. Pat. No. 3,929,678 to Laughlin et al., issued Dec. 30, 1975 at columns 19, line 38 through column 22, line 48 (herein incorporated by reference) for examples of zwitterionic surfactants.

When included therein, the laundry detergent compositions of the present invention typically comprise form 0% to about 15%, preferably from about 1% to about 10% by weight of such zwitterionic surfactants.

Semi-polar nonionic surfactants are a special category of nonionic surfactants which include water-soluble amine oxides containing one alkyl moiety of from about 10 to about 18 carbon atoms and 2 moieties selected from the group consisting af alkyl groups and hydrocyalkyl groups containing form about 1 to about 3 carbon atoms; water-soluble phosphine oxides containing one alkyl moiety of form about 10 to about 18 carbon atoms and 2 moieties selected form the group consisting of alkyl groups and hydroxyalkyl groups containing from about 1 to about 3 carbon atoms.

Semi-polar nonionic detergent surfactants include the amine oxide surfactants having the formula:

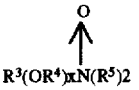

Builder

The laundry detergent compositions and automatic dishwashing compositions herein contain a builder, preferably non-phosphate detergent builders, although phosphate-containing species are not excluded in the content of the present invention. These can include, but are not restricted to alkali metal carbonates, bicarbonates, silicates, aluminosilicates, carboxylates and mixtures of any of the foregoing. The builder system is present in an amount of from 1% to 80% by weight of the composition, typically preferable from 20% to 60% by weight in granular laundry detergent compositions herein, and from 1% to 30% in liquid laundry detergent compositions herein.

Suitable silicates are those having an $SiO_2$:$Na_2O$ ratio in the range from 1.6 to 3.4, the so-called amorphous silicates of $SiO_2$:$Na_2O$ ratios from 2.0 to 2.8 being preferred.

Within the silicate class, highly preferred materials are crystalline layered sodium silicates of general formula $$NaMSi_xO_{2x+1}.^{yH20}$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. For the purposes of the present invention, x in the general formula above has a value of 2,3 or 4 and is preferably 2. More preferably M is sodium and y is 0 and a preferred example of this formula comprise the form of $Na_2Si_2O_5$. These materials are available from Hoechst AG FRG as respectively NaSKS-5, NaSKS-7, NaSKS-11 and NaSKS-6. The most preferred material is —$Na_2Si_2O_5$, NaSKS-6. Crystalline layered silicates are incorporated either as dry mixed solids, or as solid components of agglomerates with other components.

Whilst a range of aluminosilicate ion exchange materials can be used, preferred sodium aluminosilicate zeolites have the unit cell formula $$Na_z[(AlO_2)_z.(SiO_2)_y].xH_2O$$

wherein z and y are at least about 6, the molar ratio of z to y is from about 1.0 to about 0.4 and z is from about 10 to about 264. Amorphous hydrated aluminosilicate materials useful herein have the empirical formula $$M_z(zAlO_2.ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate. Hydrated sodium Zeolite A with a particle size of from about 0.01 to 10 microns is preferred.

The aluminosilicate ion exchange builder materials herein are in hydrated form and contain from about 10% to about 28% of water by weight if crystalline, and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameter" herein represents the average particle size diameter by weight of a given ion exchange material as determined by conventional analytical techniques such as, for example, microscopic determination utilizing a scanning electron microscope.

Aluminosilicate ion exchange materials useful in the practice of this invention are commercially available. The aluminosilicates useful in this invention can be crystalline or amorphous in structure and can be naturally occurring aluminosilicates or synthetically derived. A method for producing aluminosilicate ion exchange materials is discussed in U.S. Pat. No. 3,985,669, Krummel et al., issued Oct. 12, 1976, incorporated herein by reference. Preferred synthetic crystalline aluminosilicate ion exchange materials useful herein are available under the designations Zeolite A, Zeolite X, P and MAP, the latter species being described in EPA 384 070. In an especially preferred embodiment, the crystalline aluminosilicate ion exchange material is a Zeolite A having the formula $$Na_{12}[(AlO_2)_{12}(SiO2)_{12}].xH_2O$$

wherein x is from about 20 to about 30, especially about 27 and has a particle size generally less than about 5 microns.

Suitable carboxylate builders containing one carboxy group include lactic acid, glycollic acid and ether derivatives thereof as disclosed in Belgian Patent Nos. 831,368, 821,369 and 821,370. Polycarboxylates containing two carboxy groups include the water-soluble salts of succinic acid, malonic acid, (ethylenedioxy) diacetic acid, maleic acid, diglycollic acid, tartaric acid, tartronic acid and fumaric acid, as well as the ether carboxylates described in German Offenlegenschrift 2,446,686 and 2,446,687 and U.S. Pat.

No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829,1, and the 1,2,2-ethane tetracarboxylates ,1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,082,179, while polycarboxylates containing phosphone substituents are disclosed in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis,cis,cis-tetracrboxylates, 2,5-tetrahydrofuran-cis-dicarboxylates, 2,2,5,5,-tetrahydrofuran-tetracarboxylates, 1,2,3,4,5,6-hexane hexacarboxylates and carbxoymethyl derivatives of polyhydric alcohols such as sorbitol, mannitol and xylitol. Aromatic polycarboxylates include mellitic acid, pyromellitic acid and the phtalic acid derivates disclosed in British Patent No. 1,425,343.

Chelating Agents

The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetracetates, N-hydroxyethylethylene-diaminetriacetates, nitrilotriacetates, ethylenediamine tetra-prionates, triethylenetetraamine-hexacetates, diethylenetriaminepentaacetates, and ethanoldiglycines, alkali metal, ammonium, and substituted ammonium salts therein and mixtures therein.

Amino phosphonates are also suitable for use as chelating agents in the compositions of the invention when at least low levels of total phosphorous are permitted in detergent compositons, and include ethylenediaminetetrakis (methylenephosphonates) as DEQUEST. Preferred, these amino phosphonates do not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethyelediamine disuccinate ("EDDS"), especially the [S,S] isomer as described in U.S. Pat. No. 4,704,233, Nov. 3, 1987, to Hartman and Perkins.

If utilized, these chelating agents will generally comprise from about 0.1% to about 10% by weight of the detergent compositions herein. More preferably, if utilized, the chelating agents will comprise from about 0.1% to about 3.0% by weight of such compositions.

Of the above, the preferred polycarboxylates are hydroxycarboxylates containing up to three carboxy groups per molecule, more particularly citrates.

The granular detergent compositions and automatic dishwashing compositions herein have a pH above 8.5, preferably in the range of from 9 to 11.

The present laundry granular compositions are preferably in a compact form, having a bulk density of at least 650 g/l, preferably at least 750 g/l, but can also be in a conventional form, with densities in a range of from 200 g/l to 700 g/l.

In another embodiment of the invention, are provided Automatic Dishwashing Compositions: Automatic dishwashing compositions typically contain, in addition to the amylase of the invention a builder, such as described above, a source of alkalinity, such as silicate or carbonate, and a bleaching agent, preferably percarbonate, those ingredients amounting to up to 70% of the formulation. Optional ingredients include polymers and other enzymes.

In still another embodiment of the invention, are provided Laundry Additive Compositions: such compositions preferably contain in addition to the amylase of the invention, a bleaching agent at levels of from 15 to 80% by weight.

Optional Ingredients

Other ingredients which are known for use in detergent compositions may also be used as optional ingredients in the various embodiments of the present invention, such as bleaching agents, bleach activators, polymers, other enzymes, suds suppressing agents, fabric softening agents, in particular fabric softening clay, as well as dyes, fillers, optical brighteners, pH adjusting agents, non builder alkalinity sources, enzyme stability agents, hydrotopes, solvents, perfumes.

Bleaching Agents

The granular laundry detergent, automatic dishwashing compositions or laundry additives herein may contain a bleaching agent; this is a preferred ingredient in automatic dish and laundry additives herein, and in granular laundry detergents herein, although bleach-free granular detergent compositions are also desirable, particular for the treatment of certain fabrics requiring special care; therefore, such bleach-free components are also encompassed by the present invention.

The bleaching agent, if used, is either an inorganic persalt such as perborate, persulfate, percarbonate or a preformaced organic peracid or perimidic acid, such as N,N phtaloylaminoperoxy caproic acid, 2-carboxy-phtaloylaminoperoxy caproic acid, N,N phtaloylaminoperoxy valeric acid, Nonyl amide of peroxy adipic acid, 1,12 diperoxydodecanedoic acid, Peroxybenzoic acid and ring substituted peroxybenzoic acid, Monoperoxyphtalic acid (magnesium salt, hexhydrate), Diperoxybrassylic acid.

The preferred bleaching agent is percarbonate.

The bleach-containing laundry detergent of automatic diswashing compositions hererein typically contain from 1% to 40%, preferably from 3% to 30% by weight, most preferably from 5% to 25% by weight of alkali metal percarbonate bleach, in the form of particles having a mean size from 1 to 1500 micrometers, preferably from 200 to 900 micrometers, most preferably 500 to 700 micrometers.

Laundry additives typically contain from 15% to 80% of said percarbonate particles.

The alkali metal percarbonate bleach is usually in the form of the sodium salt. Sodium percarbonate is an addition compound having a formula corresponding to $2Na_2CO_3$ $3H_2O_2$. To enhance storage stability the percarbonate bleach can be coated with e.g. a further mixed salt of an alkali metal sulphate and carbonate. Such coatings together with coating processes have previously been described in GB-1,466,799, granted to Interox on 9th Mar. 1977. The weight ratio of the mixed salt coating material to percarbonate lies in the range from 1:2000 to 1:4, more preferably from 1:99 to 1:9, and most preferably from 1:49 to 1:19. Preferably, the mixed salt is of sodium sulphate and sodium carbonate which has the general formula Na2SO4.n.Na2CO3 wherein n is from 0.1 to 3, preferably n is from 0.3 to 1.0 and most preferably n is from 0.2 to 0.5.

Other suitable coating materials are sodium silicate, of $SiO_2$:$Na_2$ ratio from 1.6:1 to 2.8:1, and magnesium silicate.

Commercially available carbonate/sulphate coated percarbonate bleach may include a low level of a heavy metal sequestrant such as EDTA, 1-hydroxyethylidene 1,1-diphosphonic acid (HEDP) or an aminophosphonate, that is incorporated during the manufacturing process.

Bleach Activators

The present compositions, especially the granular laundry detergent compositions and laundry additives described above, preferably contain from 1% to 20% by weight of the composition, preferably from 2% to 15% by weight, most preferably from 3% to 10% by weight of a peroxyacid bleach activator, in addition to the bleaching agent described above.

Peroxyacid bleach activators (bleach precursors) as additional bleaching components in accordance with the invention can be selected from a wide range of class and are preferably those containing one or more N-or O-acyl groups.

Suitable classes include anhydrides, esters, amides, and acylated derivatives of imidazoles and oximes, and examples of useful materials within these classes are disclosed in GB-A-1586789. The most preferred classes are esters such as are disclosed in GB-A-836 988, 864,798, 1 147 871 and 2 143 231 and amides such as are disclosed in GB-A-855 735 and 1 246 338.

Particularly preferred bleach activator compounds as additional bleaching components in accordance with the invention are the N-,N,N'N' tetra acetylated compounds of the formula

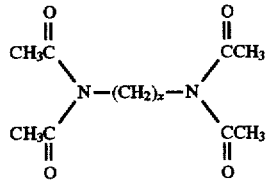

where x can be 0 or an integer between 1 and 6.

Examples include tetra acetyl methylene diamine (TAMD) in which x=1, tetra acetyl ethylene diamine (TAED) in which x=2 and Tetraacetyl hexylene diamine (TAHD) in which x=6. These and analogous compounds are described in GB-A-907 356. The most preferred peroxyacid bleach activator as an additional bleaching component is TAED.

Another preferred class of peroxyacid bleach compounds are the amide substituted compounds of the following general formulae:

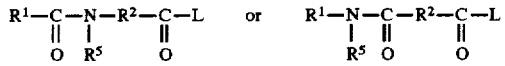

wherein $R^1$ is an aryl or alkaryl group with from about 1 to about 14 carbon atoms, $R^2$ is an alkylene, arylene, and alkarylene group containing from about 1 to about 14 carbon atoms, and $R^5$ is H or an alkyl, aryl, or alkaryl group containing 1 to 10 carbon atoms and L can be essentially any leaving group. $R^1$ preferably contains from about 6 to 12 carbon atoms. $R^2$ preferably contains from about 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms total. Amide substituted bleach activator compounds of this type are described in EP-A-0170386.

Another class of bleach activators to use in combination with percarbonate comprises $C_8$, $C_9$, and/or $C_{10}$ (6-octanamidocaproyl) oxybenzenesulfonate, 2-phenyl-(4H)3,1 benzoxazin-4-one, benzoyllactam preferably benzoylcaprolactam and nonanoyl lactam preferably nonanoyl caprolactam.

Polymers

Also useful are various organic polymers, some of which also may function as builders to improve detergency. Included among such polymers may be mentioned sodium carboxy-lower alkyl celluloses, sodium lower alkyl celluloses and sodium hydroxy-lower alkyl celluloses, such as sodium carboxymethyl cellulose, sodium methyl cellulose and sodium hydroxypropyl cellulose, polyvinyl alcohols (which often also include some polyvinyl acetate), polyacrylamides, polyacrylates and various copolymers, such as those of maleic and acrylic acids. Molecular weights for such polymers vary widely but most are within the range of 2,000 to 100,000. Also useful are terpolymers of maleic/acrylic acid and vinyl alcohol having a molecular weight ranging from 3,000 to 70,000.

Polymeric polycarboxylate builders are set forth in U.S. Pat. No. 3,308,067, Diehl, issued Mar. 7, 1967. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Polyaspartate and polyglutamate dispersing agents may be used, especially with zeolite builders. Dispersing agents such as polyasparatate preferably have a molecular weight of about 10,000.

Other useful polymers include species known as soil release polymers, such as described in EPA 185 427 and EPA 311 342.

Still other polymers suitable for use herein include dye transfer inhibition polymers such as polyvinylpyrrolidone, polyvinylpyrridine, N-oxide, N-vinylpyrrolidone, N-imidazole, polyvinyloxozolidone or polyvinylimidazole.

Other Enzymes

Enzymatic materials can be incorporated into the detergent compositions herein. Suitable are proteases, lipases, cellulases, peroxidases, amylases and mixtures thereof. A suitable lipase enzyme is manufactured and sold by Novo Industries A/S (Denmark) under the trade name Lipolase and mentioned along with other suitable lipases in EP-A-0258068 (Novo Nordisk).

Suitable cellulases are described in e.g. WO-91/17243 and WO 91/17244 (Novo Nordisk).

Preferred commercially available protease enzymes include those sold under the trade names Alcalase and Savinase by Novo Industries A/S (Denmark) and Maxatase by International Bio-Synthetics, Inc. (The Netherlands).

Other proteases include Protease A (see European Patent Application 130 756, published Jan. 9, 1985) and Protease B (see European Patent Application Serial No. 87303761.8, filed Apr. 28, 1987, and European Patent Application 130 756, Bott et al. published Jan. 9, 1985).

Peroxidase enzymes are used in combination with oxygen sources, e.g. percarbonate, perborate, persulfate, hydrogen peroxide, etc. They are used for "solution bleaching", i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813 and in WO 91/05839.

Preferred additional amylases include for example,—amylases otbained from a special strain of B. licheniforms, described in more detail in GB-1,296,839 (Novo). Preferred commercially available amylases include for example, RapidaseR, sold by International Bio-Synthetics Inc. and so-called Termamyl® 60T and Termamyl® 120T, sold by Novo Nordisk A/S.

GRANULAR DETERGENT COMPOSITIONS

| EXAMPLES | 1 | 2 | 3 | 4 | 5 | 6 | 7 | 8 | 9 | 10 | 11 | 12 | 13 | |
|---|---|---|---|---|---|---|---|---|---|---|---|---|---|---|
| Linear Alkyl Sulphonate | 7 | — | — | — | — | — | — | — | — | 0.2 | — | 17 | 7 | |
| Tallow Alkyl Sulphate | 3 | — | — | — | — | — | — | — | — | — | — | — | 4 | |
| Alkyl Sulphate | — | 9 | 11 | 3 | 7 | 7 | 7 | 7 | 6 | 5 | 6 | — | — | |
| Alkyl Ethoxylate Sulphate | 0.2 | 2 | 2 | 1 | 2 | — | 2 | 2 | — | — | — | — | — | |
| Alkyl tri-methyl Ammonium Chloride | — | — | — | — | — | 2 | — | — | — | — | — | — | — | |
| Alkyl Ethoxylate | 4 | 5 | 4 | 5 | 6 | 4 | 4 | 3 | 12 | 9 | 14 | 5 | 12 | |
| Alkyl-N-Methyl Glucosamide | — | 2 | 4 | 2 | 3 | 2 | 2 | 2 | — | — | — | — | | |
| Fatty Acid | — | — | — | 1 | — | — | — | — | 1.0 | 1.3 | 0.5 | 1.0 | 0.6 | |
| Perborate | 20 | — | — | — | — | — | — | — | — | — | — | 16 | — | |
| Percarbonate | — | 22 | 20 | 17 | — | 17 | 17 | 17 | 14 | 18 | — | — | — | |
| N,N,N,N-Tetra acetyl ethylene diamine | 5 | 6 | 3 | 6 | — | 5 | 5 | 4 | 3 | 2 | — | 5 | — | |
| Diethylene tri-amine penta (methylene phosphonic acid) | 0.4 | 0.4 | — | — | — | — | 0.5 | — | 0.2 | — | — | 0.2 | — | |
| S,S-Ethylenediamine-Di-Succinic acid | — | — | 0.4 | 0.4 | 0.4 | 0.2 | — | 0.2 | — | — | — | — | — | |
| Fungamyl (1600 FAU/g) | 0.05 | 0.1 | 0.2 | 0.1 | 0.2 | 0.1 | 0.2 | 0.2 | 0.15 | 0.2 | 0.1 | 0.2 | 0.2 | |
| Lipase (Lipolase 165 KLU) | 0.3 | 0.2 | 0.2 | 0.4 | 0.1 | 0.2 | 0.2 | 0.2 | 0.2 | — | — | — | — | |
| Cellulose (1000 cevu) | 0.1 | 0.2 | 0.1 | 0.2 | 0.1 | 0.2 | 0.2 | 0.2 | — | — | 0.1 | 0.1 | 0.1 | |
| Endoglucanase (5000 s-cevu) | — | 0.1 | 0.2 | 0.1 | — | — | 0.1 | 0.1 | — | — | — | — | — | |
| Protease (Savinase 13 KNPU) | 0.4 | 0.5 | 0.5 | 0.1 | — | 0.4 | 0.4 | 0.7 | 0.6 | 0.6 | 0.6 | — | — | |
| Termamyl (60T) | — | — | 0.3 | — | — | — | — | 0.3 | — | — | — | — | — | |
| Alcolase (3 AU) | — | — | — | — | 0.5 | — | — | — | — | — | — | 2 | 2 | |
| Aluminosilicate (Zeolite A) | 20 | 14 | 15 | 30 | 15 | 10 | 10 | 10 | 40 | 30 | 30 | 21 | 37 | |
| Layered silicate/ citric acid | — | 12 | 9 | — | | | | | — | — | — | — | — | |
| Sodium citrate | 5 | 5 | — | 1 | | — | — | — | — | — | 17 | — | 3 | |
| Sodium carbonate | 16 | 8 | 4 | 15 | 8 | 6 | 6 | 6 | 7 | 13 | 5 | 7 | 9 | |
| Sodium silicate | 3 | — | — | — | — | — | — | — | 6 | 6 | — | 2 | 4 | |
| Sulphate | — | — | 0.5 | — | — | — | — | — | 2 | — | — | 2 | 2 | |
| Maleic & Acrylic acid sodium salt, copolymer | 4 | 5 | 5 | 8 | 4 | 3 | 3 | 3 | — | — | — | 5 | — | — |
| Carboxymethyl cellulose, sodium salt | 0.3 | 0.4 | 0.3 | 0.3 | 0.3 | 0.3 | 0.3 | 0.3 | — | — | — | 0.2 | 0.1 | — |
| Soil Release Polymer | 0.3 | 0.3 | 0.3 | 0.3 | 0.2 | 0.3 | 0.3 | 0.3 | — | — | — | — | — | — |
| Polyvinylpyridone | — | — | — | 1 | — | — | — | — | — | — | — | — | — | — |
| Polyvinyl-N-Oxide | — | 0.03 | — | — | 0.2 | — | — | — | — | — | — | — | — | — |
| PVP-PVPVI copolymer | — | — | 0.4 | — | — | 0.02 | 0.02 | 0.02 | — | — | — | — | — | — |
| PEG | — | — | — | 0.5 | 0.5 | — | — | — | — | — | — | — | — | — |
| Brighteners, suds suppressors, perfume | 0.2 | 0.3 | 0.3 | 0.2 | — | 0.2 | 0.2 | 0.2 | 0.2 | 0.2 | — | 0.2 | — | 0.2 |

LIQUID DETERGENT COMPOSITIONS

| | 14 | 15 | 16 | 17 | 18 | 19 |
|---|---|---|---|---|---|---|
| Linear Alkyl Sulphonate | 10 | 20 | 30 | — | — | — |
| Alkyl Sulphate | — | — | — | 10 | 15 | 20 |
| Alkyl Ethoxylate Sulphate | — | — | — | 5 | 3 | 0 |
| Alkyl-N-Methyl Glucosamide | — | — | — | 5 | 6 | 0 |
| Fatty Acid | 8 | 10 | 13 | 12 | 10 | 12 |
| Fatty Acid | 5 | 5 | — | — | — | — |
| Alkyl Ethoxylate | 15 | 12 | 8 | 5 | 5 | 5 |
| Citric Acid (Anhydrous) | 10 | 5 | 2 | 2 | 2 | 2 |
| Diethylene tri-amine penta (methylene phosphonic acid) | 1 | 1 | 1 | 1 | 1.5 | 2 |
| Monoethanol Amine | 9 | 11 | 13 | 7 | 9 | 11 |
| NaOH, KOH | 2 | 2 | 2 | 1 | 2 | 3 |
| Ethanol | 1 | 1.5 | 2 | 1 | 3 | 5 |
| Propenediol | 13 | 11 | 9 | 25 | 20 | 15 |
| Boric Acid | 1 | 2 | 3 | 4 | 5 | 6 |
| Calcium Chloride | 0.02 | 0.02 | — | — | — | — |
| Protease 10T | 0.3 | 0.5 | 0.5 | 0.5 | 0.5 | 0.5 |
| Lipase 100 KLU | 0.1 | 0.15 | 0.2 | 0.1 | 0.15 | 0.2 |
| Termamyl 60T | 0.1 | 0.1 | 0 | 0.2 | 0.15 | 0.1 |
| Carezyme 5000 cevu | — | — | 0.1 | 0.1 | 0.15 | 0.1 |
| Endoglucanase 5000 s-cevu | — | — | 0.15 | 0.1 | 0.2 | 0.1 |
| Fungamyl (1600 FAU/g) | 0.2 | 0.2 | 0.15 | 0.2 | 0.15 | 0.2 |

EXPERIMENTAL EVIDENCE

The composition of Example 2 above was compared for cleaning of body soils and whiteness maintenance benefits, to the same composition without Fungamyl®.

The materials tested where dingy and greasy items, washed at 40° C. with two long cycles.; the washed items were judged by panellists and results are given in panel score units: Comparative cleaning assessment was done by expert judges using a scale of a 0 to 4 panel-score-units. In this scale 0 is given for no difference and 4 is given for maximum difference.

| ITEM (Benefit tested) | Example 2 | Example 2 (without Fungamyl ®) |
|---|---|---|
| Pillow (whiteness maintenance) | +0.9* | Ref |
| Shirt collor (body soil cleaning) | +0.8* | Ref |

-continued

| ITEM (Benefit tested) | Example 2 | Example 2 (without Fungamyl ®) |
|---|---|---|
| Shirt cuff (body soil cleaning) | +1.1* | Ref |
| Tea towel (whiteness maintenance) | +0.4 | Ref |

*Statistically significant at 95% confidence.

We claim:

1. A detergent composition comprising the following:
(a) 3% to 20% of an anionic surfactant component which comprises an alkyl sulfate and an alkyl ethoxy sulfate;
(b) 5% to 40% of a nonionic surfactant which comprises alkyl ethoxylate and alkyl n-methyl glucose amide;
(c) 3% to 30% of a bleaching agent which is a percarbonate bleach;
(d) 2% to 15% of a bleach activator which comprises N,N,N,N-tetra acetyl ethylene diarnine and diethylene triamine penta phosphonic acid;
(e) 0.1% to 0.5% of an amylase which is a 1,4-D-glucan glucano-hydrolase obtained from Asperillys oryzae having CMCase activity;
(e) additional adjuvants selected from the group consisting of additional enzymes, builders, fillers, soil release polymers, brighteners, suds suppressors, and perfume ingredients.

2. A composition in accordance with claim 1 which is a laundry detergent composition in granular form, having a pH above 8.5.

3. A composition in accordance with claim 1 which is a laundry detergent composition in liquid form.

4. A composition in accordance with claim 1 which is a laundry detergent additive.

5. A composition in accordance with claim 1 wherein said percarbonate has an average particle size of from 1 to 1500 micrometers.

6. A composition in accordance with claim 5 wherein said percarbonate has an average particle size of from 200 to 900 micrometers.

7. A composition in accordance with claim 6 wherein said percarbonate has an average particle size of from 500 to 700 micrometers.

* * * * *